US008882232B2

(12) United States Patent
Ibe et al.

(10) Patent No.: US 8,882,232 B2
(45) Date of Patent: Nov. 11, 2014

(54) INKJET PRINT APPARATUS AND INKJET CONTROL METHOD FOR REMOVING INK FROM A RECEIVING UNIT

(75) Inventors: Tsuyoshi Ibe, Yokohama (JP); Masaya Uetsuki, Yokohama (JP); Kazuo Suzuki, Yokohama (JP); Toshimitsu Danzuka, Tokyo (JP); Masataka Kato, Yokohama (JP); Asako Tomida, Kawasaki (JP); Hiroaki Komatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 173 days.

(21) Appl. No.: 13/358,765

(22) Filed: Jan. 26, 2012

(65) Prior Publication Data

US 2012/0188304 A1 Jul. 26, 2012

(30) Foreign Application Priority Data

Jan. 26, 2011 (JP) ..... 2011-014314

(51) Int. Cl.
*B41J 29/393* (2006.01)
*B41J 29/38* (2006.01)
*B41J 2/165* (2006.01)

(52) U.S. Cl.
CPC ..... *B41J 29/38* (2013.01); *B41J 2/16538* (2013.01); *B41J 2/16547* (2013.01)
USPC ..... 347/19; 347/23; 347/30; 347/31

(58) Field of Classification Search
USPC ..... 347/19, 22–23, 29–31, 33, 35–36
See application file for complete search history.

(56) References Cited

U.S. PATENT DOCUMENTS 6,447,095 B1 9/2002 Kanda et al.
6,527,361 B1 3/2003 Gotoh et al.
6,557,969 B1 5/2003 Murakami et al.
6,644,777 B2 11/2003 Danzuka
6,702,421 B2 3/2004 Inui et al.
6,719,400 B2 4/2004 Inui et al.
6,752,485 B2 6/2004 Murakami et al.
6,854,826 B2 2/2005 Kanda et al.
6,984,018 B2 1/2006 Uetsuki et al.
7,290,858 B2 11/2007 Furuichi et al.
7,794,041 B2 * 9/2010 Akase et al. ..... 347/19

FOREIGN PATENT DOCUMENTS

JP 03-234664 A 10/1991
JP 2002-052740 A 2/2002
JP 2002-052744 A 2/2002
JP 2007-307749 A 11/2007
JP 2008-207560 A 9/2008
JP 2008-238431 A 10/2008

OTHER PUBLICATIONS

Aug. 26, 2014 Japanese Office Action in Japanese Patent Application No. 2011-014314.

* cited by examiner

*Primary Examiner* — Juanita D Jackson
(74) *Attorney, Agent, or Firm* — Fitzpatrick, Cella, Harper & Scinto

(57) ABSTRACT

When performing at least one of preliminary ejection or a suction unit as a countermeasure against adhering ink that accumulates in the portion where preliminary ejection is performed, the preliminary ejection amount and suction speed of the suction unit are optimized. An inkjet print apparatus that prints by using a printing head for ejecting ink, comprising: an ejecting unit; a sucking unit; a measuring unit that measures an elapsed time after the sucking unit is performed; and a control unit that control ejection by the ejecting unit or sucking by the sucking unit according to the elapsed time measured in the measuring unit; wherein as the elapsed time becomes longer, the amount of ink that is ejected to the ink receiving unit in the ejecting unit is increased or a suction speed at which the ink is sucked in the sucking unit is increased.

15 Claims, 12 Drawing Sheets

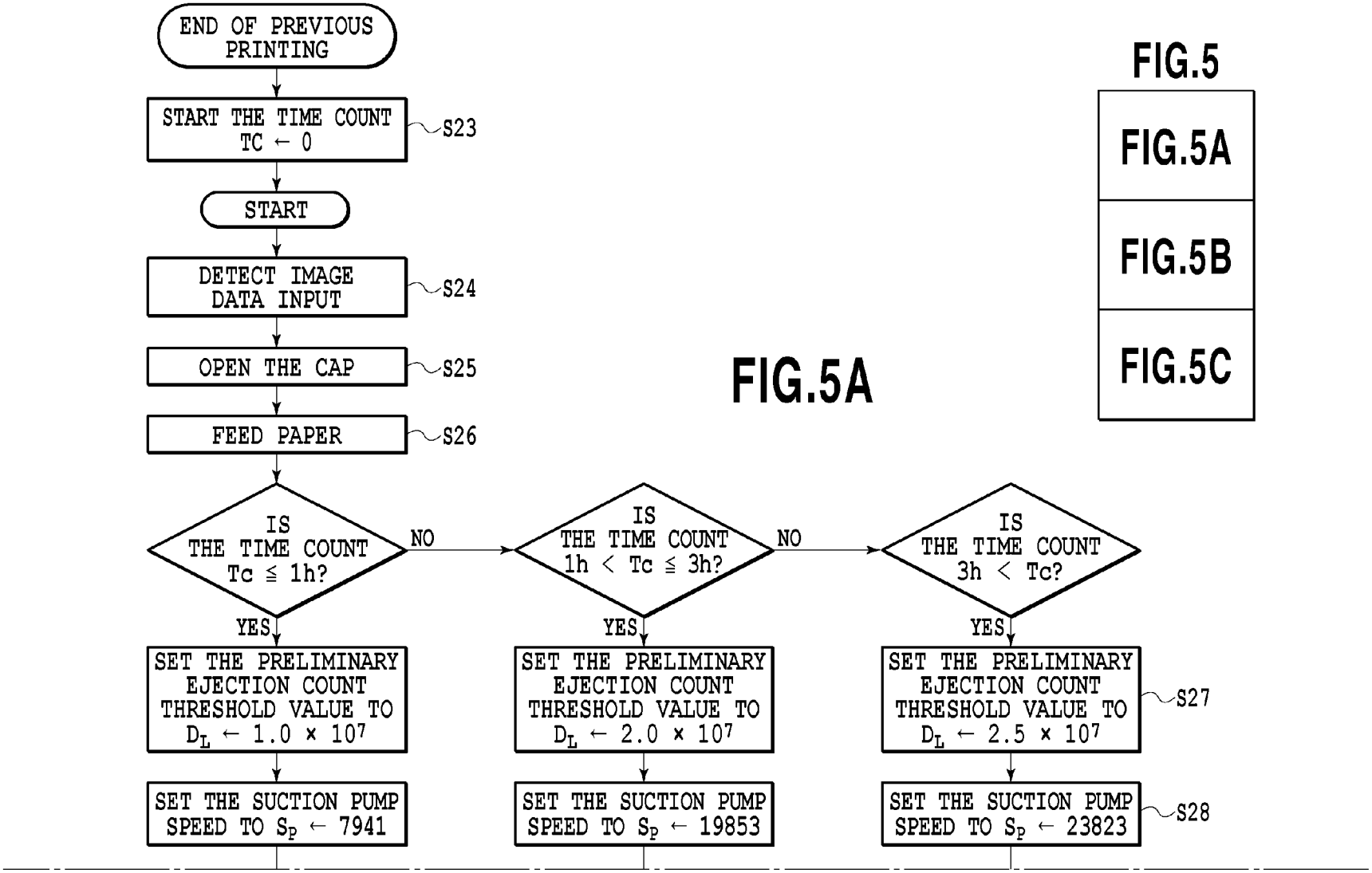
FIG.5
FIG.5A
FIG.5B
FIG.5C
FIG.5A
END OF PREVIOUS PRINTING
S23
START THE TIME COUNT TC ← 0
START
S24
DETECT IMAGE DATA INPUT
S25
OPEN THE CAP
S26
FEED PAPER
IS THE TIME COUNT Tc ≦ 1h?
YES
NO
SET THE PRELIMINARY EJECTION COUNT THRESHOLD VALUE TO $D_L$ ← 1.0 × $10^7$
SET THE SUCTION PUMP SPEED TO $S_P$ ← 7941
IS THE TIME COUNT 1h < Tc ≦ 3h?
YES
NO
SET THE PRELIMINARY EJECTION COUNT THRESHOLD VALUE TO $D_L$ ← 2.0 × $10^7$
SET THE SUCTION PUMP SPEED TO $S_P$ ← 19853
IS THE TIME COUNT 3h < Tc?
YES
S27
SET THE PRELIMINARY EJECTION COUNT THRESHOLD VALUE TO $D_L$ ← 2.5 × $10^7$
S28
SET THE SUCTION PUMP SPEED TO $S_P$ ← 23823

| | | TEMPERATURE [°C] | | |
|---|---|---|---|---|
| | | ~18 | 18~28 | 28~40 |
| HUMIDITY[%] | 5~35 | 1.2 | 1.5 | 2 |
| | 35~65 | 0.8 | 1 | 1.3 |
| | 65~90 | 0.5 | 0.7 | 1.9 |

FIG.7

| FIG.8A | FIG.8B | FIG.8C |
|---|---|---|

INKJET PRINT APPARATUS AND INKJET CONTROL METHOD FOR REMOVING INK FROM A RECEIVING UNIT

BACKGROUND OF THE INVENTION

1. Field of the Invention

The present invention relates to a control method for an inkjet print apparatus and to an inkjet print apparatus, and more particularly to a control method of removing ink from an ink receiving unit for receiving ink that has been preliminary ejected.

2. Description of the Related Art

In an inkjet print apparatus, the place where preliminary ink ejection is performed in order to recover the printing head is usually inside a cap that seals the ejection surface (hereafter, is called the face surface) of the printing head when performing suction-based recovery, or is a specially provided ink receiving unit that has a suction unit. In this place, normally an absorber or the like is provided that holds collected ejected ink.

The amount of ink that is used in one preliminary ejection during the printing operation is a small amount, so in the place where the collected ink is held, the ink accumulates over a comparatively long period of time. The accumulated ink is ejected into a waste ink tank by a suction means, however, during the suction means, if suction is performed when there is not a sufficient level of ink inside the absorber, air is sucked in and ink remains in the place where the collected ink is held. When this remaining accumulated ink is left for a long period of time, the moisture content evaporates, and the ink inside the absorber or suction pump thickens and becomes firmly adhered to the absorber, suction pump and flow path leading to the waste ink tank.

This adhered ink is re-dissolved to a certain extent by preliminary ejection and the suction means, and ejected to the waste ink tank. However, problems may occur such as ink that has adhered by using the ink over a long period of time accumulating and blocking the ink flow path, causing the ink in the portion where the preliminary ejection is performed to overflow, or the accumulated ink on the absorber being transferred to the face surface, causing poor ink ejection or misdirection to occur. Moreover, this accumulated ink is difficult to remove and it may become necessary to disassemble and clean the print apparatus, which in that case requires a lot of work and time.

Technology for suppressing ink from adhering in this way is known in which in addition to preliminary ejection in order to prevent the nozzles from drying out, a separate preliminary ejection is performed in order to re-dissolve the adhering ink, and then the adhering ink is cleaned away by executing a suction means after that (for example, refer to Japanese Patent Laid-Open No. 2002-052744). When performing a preliminary ejection in order to re-dissolve the adhering ink, there is no increase in component parts, so the adhering ink can be effectively removed without the mechanism and control becoming complex.

However, the technology disclosed in Japanese Patent Laid-Open No. 2002-052744 does not estimate to what extent the ink has adhered (accumulated), so it is necessary to reduce the adhering ink by performing this preliminary ejection until the cap become nearly full, and then sucking the ink by the suction means. Therefore, a large amount of ink is used, so wasted ink increases, and the running cost may become high.

SUMMARY OF THE INVENTION

Taking the problems above into consideration, the object of the present invention is to provide an inkjet print apparatus that is capable of suppressing the amount of wasted ink used for dissolving accumulated adhering ink in the portion where preliminary ejection is performed.

In order to accomplish the objective above, the present invention is an inkjet print apparatus that prints by using a printing head for ejecting ink, comprising: an ejecting unit that ejects the ink from the printing head to an ink receiving unit; a sucking unit that sucks the ink that is received in the ink receiving unit; a measuring unit that measures an elapsed time after the sucking unit is performed; and a control unit that controls ejection by the ejecting unit or sucking by the sucking unit according to the elapsed time measured in the measuring unit; wherein as the elapsed time becomes longer, the amount of ink that is ejected to the ink receiving unit in the ejecting unit is increased or a suction speed at which the ink is sucked in the sucking unit is increased.

With the construction described above, as the elapsed time of the previous operation becomes longer, the number of times preliminary ejection is performed in order to dissolve adhering ink in the ink receiving unit is increased. As a result, it is possible to suppress the amount of ink that is used for dissolving adhering ink that accumulates in the portion where preliminary ejection is performed.

Further features of the present invention will become apparent from the following description of exemplary embodiments (with reference to the attached drawings).

BRIEF DESCRIPTION OF THE DRAWINGS

FIG. 5 is a diagram showing the relationship of FIG. 5A to FIG. 5C;

FIG. 5A is a flowchart illustrating the recovery control procedure of the first embodiment;

FIG. 7 is a table illustrating the relationship between the operating environment of the print apparatus and weighting coefficients of the second embodiment;

DESCRIPTION OF THE EMBODIMENTS

In the following, embodiments of the present invention will be explained in detail with reference to the accompanying drawings.

(Embodiment 1)

Figure 1A:
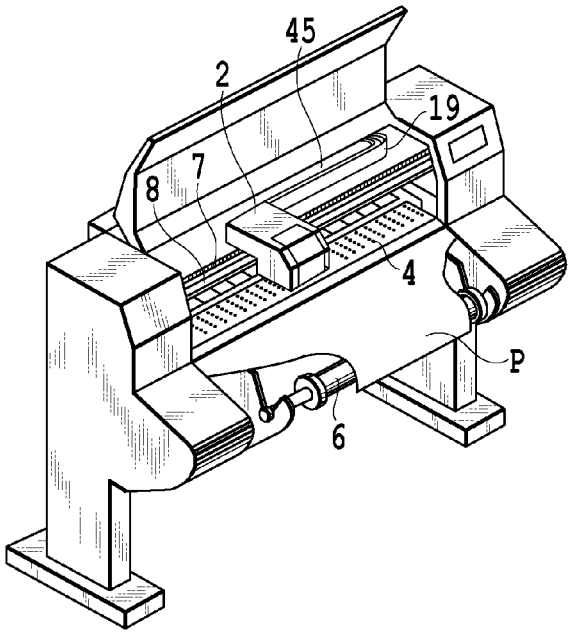
FIGS. 1A to 1C are drawings illustrating a print apparatus, a printing head and the internal mechanism of the print apparatus, of a first embodiment of the present invention.

FIG. 1A is a simplified drawing illustrating the inkjet print apparatus of this first embodiment of the present invention. The inkjet print apparatus of this embodiment is a so-called serial-scan type print apparatus, and forms an image by scanning (main scan) with the printing head in a direction (main scanning direction) that is orthogonal to the conveyance direction of the printing medium P.

When performing printing, a printing medium P is conveyed by a spool 6 that holds the printing medium P by a paper feeding roller (not illustrated in the figure) that is driven by way of a paper feeding motor via a gear (not illustrated in the figure). At a specified conveyance position a carriage motor (not illustrated in the figure) causes a carriage unit to scan along a guide shaft 8 that extends in a direction that is orthogonal to the conveyance direction. In this scanning process, at timing that is based on a position signal that is obtained by an encoder 7, an ejection operation that ejects ink from ink ejection ports of the printing head that is removably mounted in the carriage unit 2 is performed, causing the printing head to print a fixed band width that corresponds to a nozzle array range. After that, the printing medium is conveyed and printing of the next band width is performed.

Figure 1B:
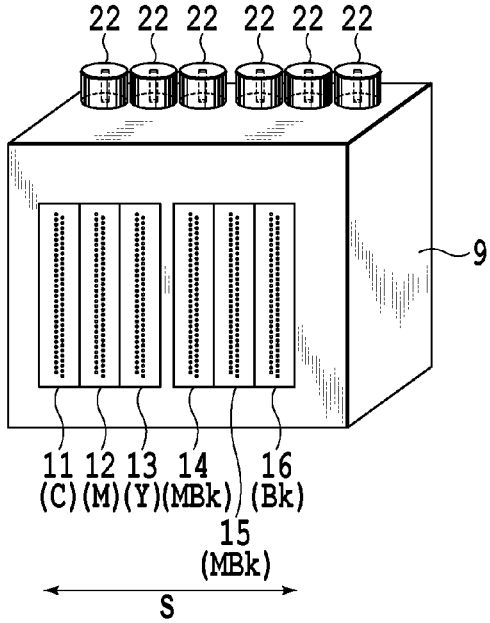

FIG. 1B is a perspective drawing schematically illustrating the printing head of this embodiment. A plurality of ejection units 11 to 16 that can eject ink drops of ink of different color tones (including color, and density), for example, cyan (C), magenta (M), yellow (Y), matte black (MBk) and black (Bk) ink, are arranged in the main scanning direction S in the printing head 9. Ink is supplied from an ink introduction unit 22 to each ejection unit via ink flow paths inside the printing head 9. Ink is introduced into the ink introduction unit 22 from ink tanks that are described later via tubes.

Figure 1C:
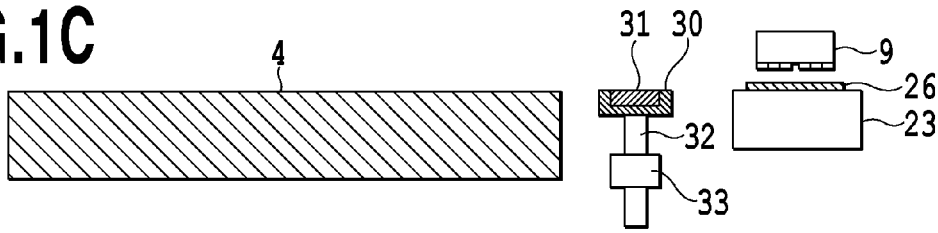

FIG. 1C is a simplified diagram of the internal mechanism of the inkjet print apparatus of this embodiment that is illustrated in FIG. 1A. The carriage unit 2 stops at the home position and back position as necessary before printing begins, or during printing. As illustrated in the figure, a recovery unit 23 that includes a cap and wiper, and an ink receiving unit 30 are located near the home position. The ink receiving unit 30 is located outside the range of the printing medium, and is provided at a position that faces the printing head so that it can receive the ink that was preliminary ejected from the printing head.

Figure 2:
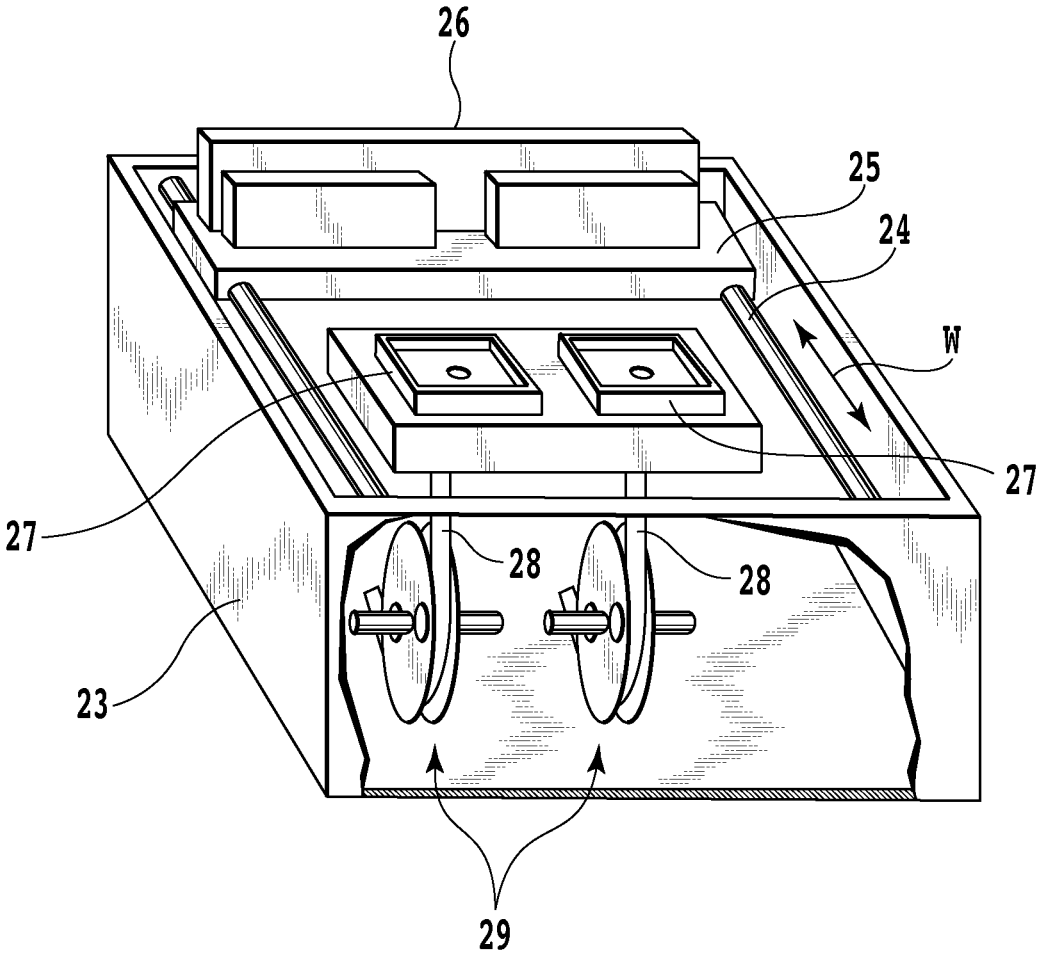
FIG. 2 is a schematic perspective drawing illustrating the construction of a recovery unit of the first embodiment.

FIG. 2 is a schematic perspective drawing illustrating the construction of the recovery unit 23. Caps 27 are supported by a raising and lowering mechanism (not illustrated in the figure) so that they can be raised or lowered, and when the caps 27 are in the raised position, the caps 27 cap the face surfaces of three ejection units for example, and can protect those face surfaces during the no-printing operation, or perform suction-based recovery. During the printing operation, the caps 27 are set at the lowered position to avoid interference with the printing head 9, and by facing the face surfaces, are able to receive preliminary ejection. Moreover, in order to wipe away ink that adheres to the face surfaces, wiping is performed that wipes the face surfaces with a rubber wiper 26.

When the caps 27 are in contact with the face surfaces and sealed spaces are formed inside, suction pumps 29 generate a negative pressure, which causes ink from the ink tank to be filled into the printing head 9 or inside the ejection units. The suction pumps 29 can also suck out and remove any dust, adhering matter, air bubbles or the like inside the ejection ports or internal ink paths. In this embodiment, a tube pump type of suction pump 29 is used. Each suction pump 29 has a member formed with a curved surface that holds along a tube 28 (at least part of the tube) that is made of a flexible material, a roller that faces this member and can press the flexible tube, and a roller support unit that can rotate and that supports the roller. In other words, by rotating the roller support unit in a specified direction, the roller rotates over the member with the curved surface while pressing the flexible tube. As the roller presses the tube, negative pressure is created inside the sealed space formed by the cap 27 and ink is sucked from the ejection port and sucked into the tube and suction pump, after which the sucked in ink is fed toward a suitable member (waste ink absorber).

The suction pump 29 not only performs this kind of suction-based recovery, but can also be operated to eject ink that is received in the cap 27 by the preliminary ejection operation that is performed with the cap 27 facing the face surface. In other words, by operating the suction pump 29 when the ink that was preliminary ejected and held in the cap 27 reaches a specified amount, it is possible to transfer the ink that is held inside the cap 27 to the waste ink absorber via the tube 28.

Figure 3:
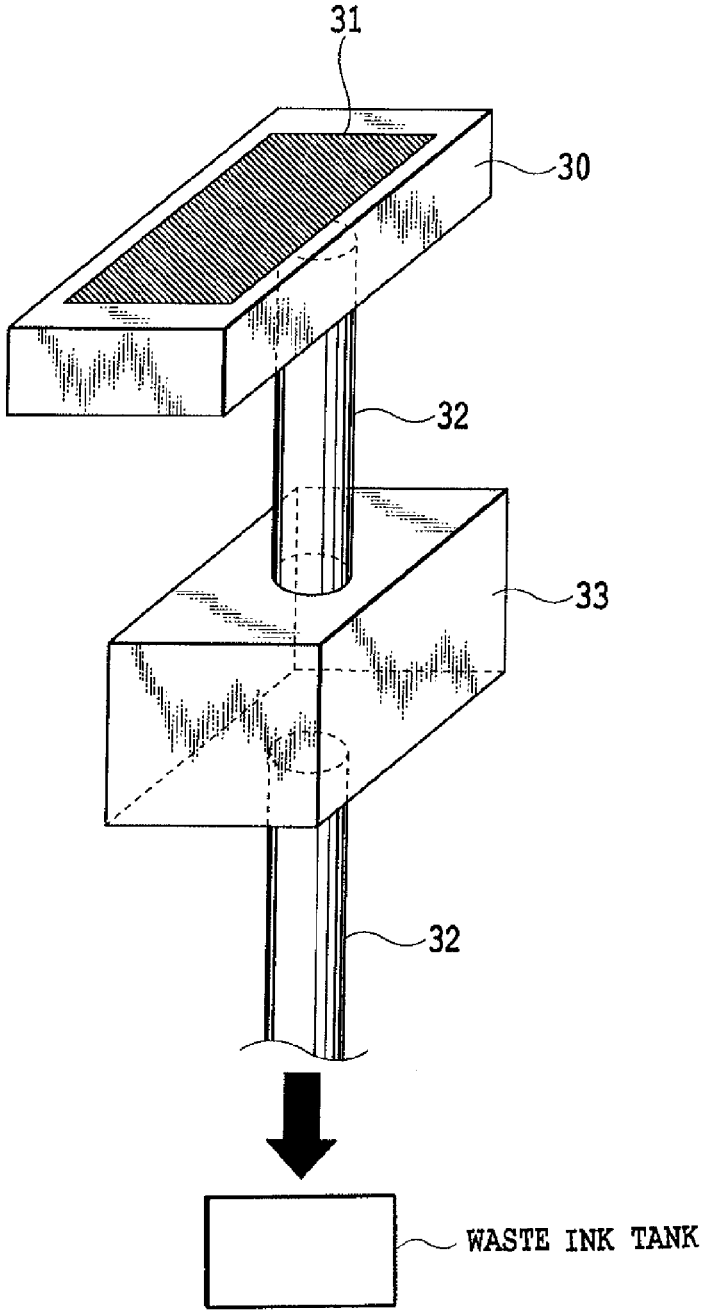
FIG. 3 is a schematic perspective drawing illustrating the construction of an ink receiving unit and a pump of the first embodiment.

FIG. 3 is a schematic perspective drawing illustrating the construction of the ink receiving unit and the corresponding pump for one kind of ink (for example, matte black) of the ink receiving unit 30 illustrated in FIG. 1C. There is an ink receiving unit 30 of this embodiment independently provided for each ink color. An absorber 31 that holds accumulated ink is located in the ink receiving unit 30. One end of an ink flow path 32 is connected to the bottom surface of the ink receiving unit 30, and the other end is connected to the suction pump 33. The suction pump 33 can change the suction amount per unit time (speed) and when performing suction. The same tube pump type of suction pump that was used in the recovery unit 23 can be used for this suction pump 33. Furthermore, one end of the ink flow path is connected to the bottom surface of the suction pump 33 and the other end is connected to the waste ink tank, and this ink flow path directs sucked up ink to the waste ink tank.

An ink receiving unit 30 of this embodiment is independently provided for each ink color, however, the present invention could also be constructed such that inks that will not react when mixed together are preliminarily ejected to the same location.

Figure 4:
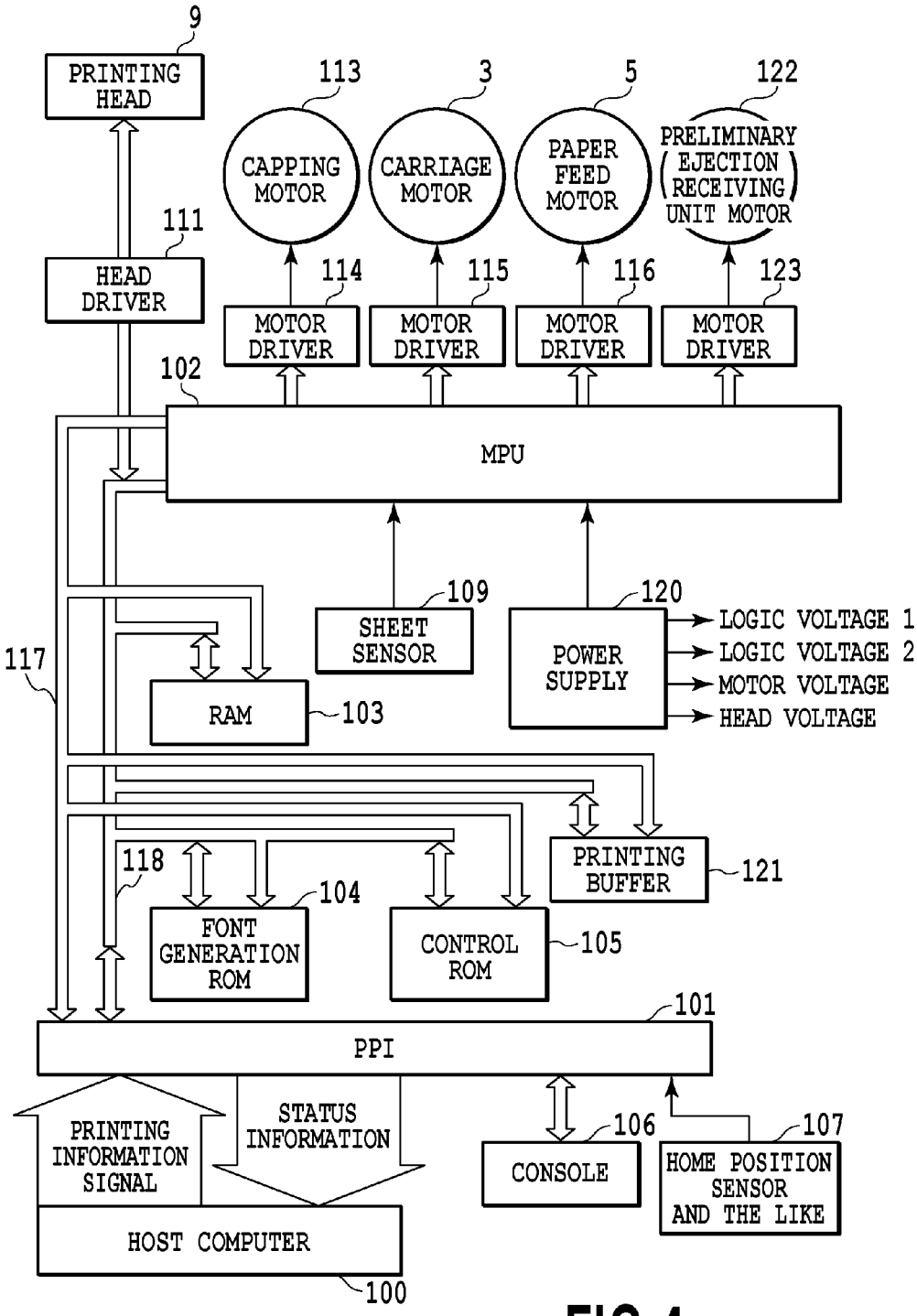
FIG. 4 is a block diagram illustrating the construction of the control circuit of the print apparatus of the first embodiment.

FIG. 4 is a block diagram illustrating the construction of a control circuit of the print apparatus of this embodiment. A programmable peripheral interface (PPI) 101 receives printing information signals, which include instruction signals (commands) and printing data that are sent from a host computer 100, and transfers the signals to an MPU 102. The MPU 102 performs the control illustrated in FIG. 5, which will be described later. The PPI 101 also sends status information about the print apparatus to the host computer 100 as necessary. Furthermore, the PPI 101 performs input and output with a console 106 that has a setting input unit where a user sets various settings for the print apparatus, and a display unit that displays messages to the user. The PPI 101 also receives signal input from a sensor group 107 that includes a home position sensor, which detects when the carriage unit 102 or printing head 9 is in the home position, a capping sensor and the like.

The MPU (micro processing unit) 102 controls all of the parts inside the print apparatus according to a control program that is stored in a control ROM 105 and that corresponds to a processing procedure that is described later. A RAM 103 stores received signals, or is used as a work area for the MPU 102 and temporarily stores various data. A font generation ROM 104 stores characters that correspond to code information or pattern information for printing or the like, and outputs various kinds of pattern information that corresponds to inputted code information. A printing buffer 121 stores printing data that is expanded in the RAM 103 or the like, and has a capacity equal to M lines of printing. In addition to the control program, it is also possible to store fixed data that corresponds to data that is used in the control process described later (for example, data for setting whether or not to execute preliminary ejection, which is concerned with the principal part of this embodiment) in the control ROM 105. All of these components are controlled by the MPU 102 via an address bus 117 and data bus 118.

A capping motor 113 is the driving source for raising or lowering the cap 27, moving a wiper holder 25 and operating the pumps 29. An ink receiving unit motor 122 is the driving source for operating the suction pump 33. The motor drivers 114, 115, 116 and 123 respectively drive the capping motor 113, carriage motor 3, paper feeding motor 5 and ink receiving unit motor 122 according to control from the MPU 102.

A sheet sensor 109 detects whether or not there is printing medium, or in other words, detects whether or not printing medium has been supplied to a position where printing by the printing head 9 is possible. A head driver 111 drives a heating unit 52 of the printing head 9. A power supply unit 120 supplies electric power to each unit, and has an AC adapter and battery as the driving power supply device.

The printing system comprises a print apparatus and a host computer 100 that supplies printing information signals to the print apparatus. When this printing system transmits printing data via a parallel port, infrared port, network or the like, the required command is attached to the beginning part of that data. That command could be the type of printing medium on which printing is to be performed (type such as normal paper, OHP sheet, glossy paper, or type of special printing medium such as transfer film, thick paper, banner paper and the like), medium size (size such as A0, A1, A2, B0, B1, B2 and the like), printing quality (draft, high quality, medium quality, special color emphasis, type of monochrome/color and the like), paper feeding path (set according to the form and type of paper feeding unit for printing medium the print apparatus has; for example ASF, manual feeding, paper feeding cassette 1, paper feeding cassette 2 and the like), whether or not there is auto detection of the object or the like. Moreover, when construction is employed that gives a treatment liquid for improving the fixing of the ink on the printing medium, information for setting whether or not to give that liquid can be sent as a command.

According to these commands, the print apparatus reads the necessary data for printing from the ROM 105 described above, and performs printing based on that data. That data could be data for setting the number of printing passes when performing multi-pass printing, the amount of ink to eject per unit area of the printing medium, the printing direction and the like. In addition to that, the data could also set the type of mask for data culling that is applied when performing multi-pass printing, the driving conditions of the printing head 9, the dot size, the conveyance conditions of the printing medium, the carriage speed and the like.

Next, the recovery control procedure of this embodiment for preventing improper ejection of the print apparatus will be explained.

In the present invention, the amount of time that elapses from the suction means at the end of the previous printing operation is measured, and as the amount of elapsed time increases, either the number of times preliminary ejection for dissolving ink that has adhered to the ink receiving unit is increased, or the suction force on the ink receiving unit is performed, or both are performed. This will be explained in detail below.

Figure 5B:
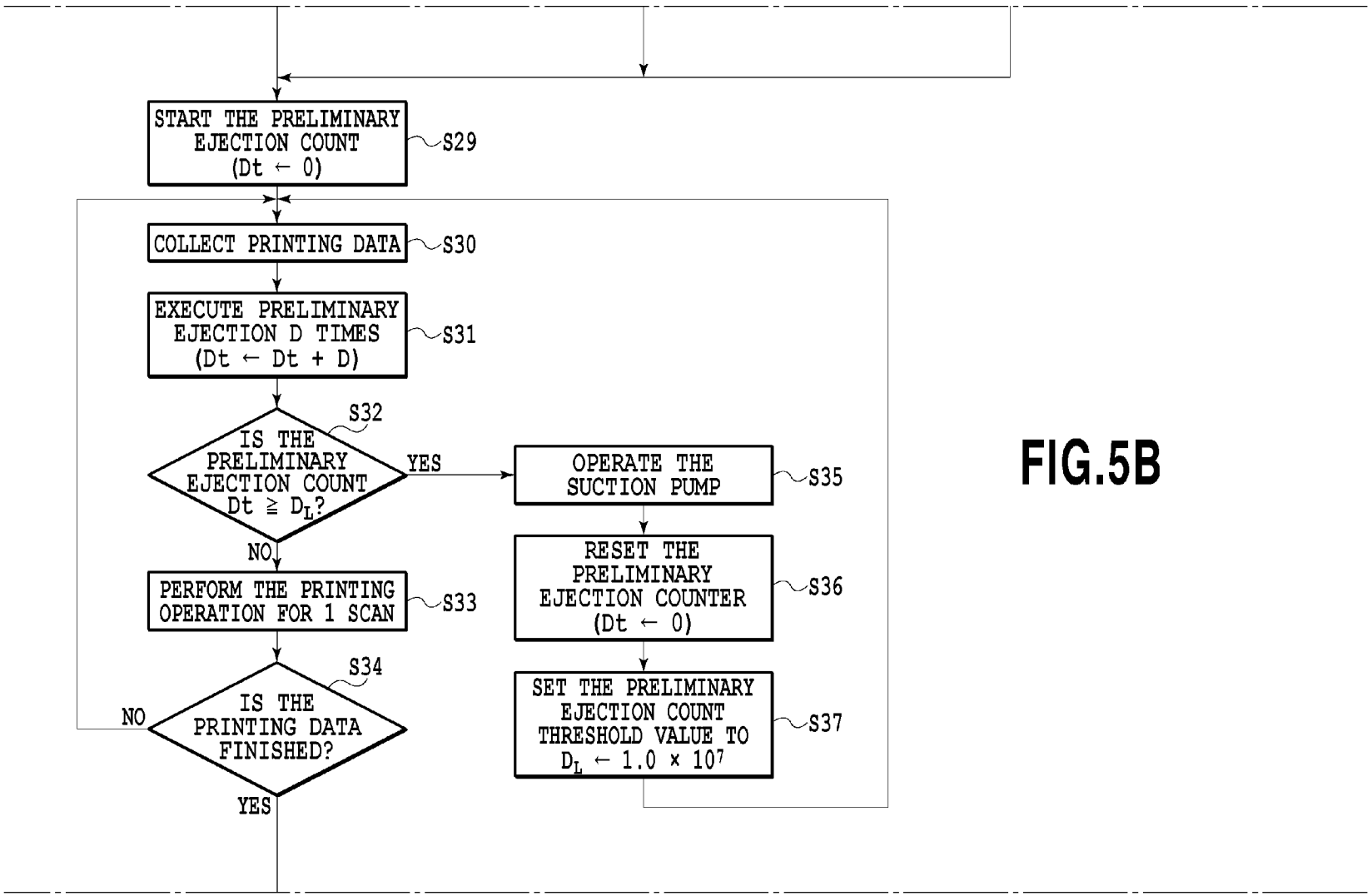
FIG. 5B is a flowchart illustrating the recovery control procedure of the first embodiment.
Figure 5C:
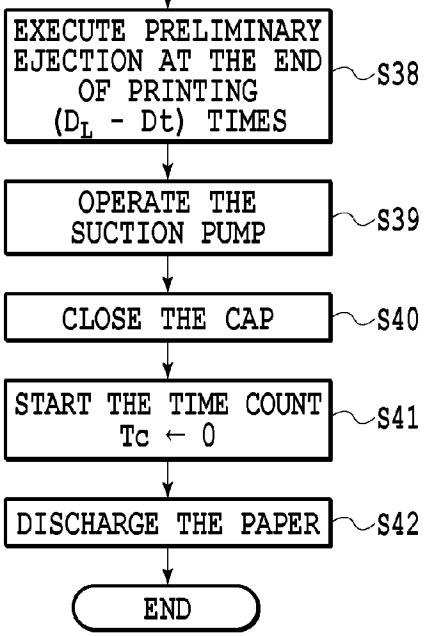
FIG. 5C is a flowchart illustrating the recovery control procedure of the first embodiment.

FIG. 5 is a flowchart for illustrating the recovery control procedure of this embodiment for preventing improper ejection. In this embodiment, preliminary ejection into the ink receiving unit is performed for each scan, and the suction means is performed during the printing operation and after the printing operation ends.

After the previous printing operation ends, the time count begins (step S23). In other words, the time count $T_c$ is set to 0, and time count is performed. As a result, it is possible to control the elapsed time after the suction means for sucking out the ink remaining in the ink receiving unit.

When image data is inputted (step S24), printing begins. The cap is opened (step S25), the printing medium is fed (step S26) and conveyed to the printing start position.

Next, measurement of the time count ends, and from the time count $T_c$, a preliminary ejection count threshold value $D_L$ for ink dissolving is selected (step S27) and the suction pump speed $S_P$, or in other words the suction strength, is selected (step S28).

The preliminary ejection count threshold value $D_L$ and the suction pump speed $S_p$ are set to larger values the longer the time count $T_c$ is. In this embodiment, there is an independent ink receiving unit for each ink, so a preliminary ejection count threshold value $D_L$ is set for each ink. In the present invention, there does not need to be an independent ink receiving unit for each ink, and in that case, it is not necessary to set a preliminary ejection count threshold value $D_L$ for each ink. In this embodiment of the present invention, when the time count is $T_c \leq 1$ h, the preliminary ejection count threshold value is set to $D_L=1.0\times10^7$ dots, and the suction pump speed is set to $S_p=7941$. When the time count is 1 h$<T_c\leq$3 h, the preliminary ejection count threshold value is set to $D_L=2.0\times10^7$ dots, and the suction pump speed is set to $S_p=19853$. Moreover, when the time count is 3 h$<T_c$, the preliminary ejection count threshold value is set to $D_L=2.5\times10^7$ dots, and the suction pump speed is set to $S_p=23823$.

After the preliminary ejection count threshold value $D_L$ and suction pump speed $S_P$ have been set, the preliminary ejection count is started (step S29). In other words, the preliminary ejection count value $D_t$ is set to 0. Next, processing waits until the amount of data for one scan is accumulated in the printing buffer 121 (step S30), and the preliminary ejection is performed D times (step S31). The preliminary ejection count $D_t$ is increased by the amount D.

After preliminary ejection, it is determined whether the preliminary ejection count Dt exceeds the preliminary ejection count threshold value $D_L$ (step S32). When the judgment result is NO, the carriage motor 3 causes the carriage unit 2 to scan, and the printing operation is performed for the accumulated amount of data for one scan (step S33). After the printing operation has been performed for one scan, it is determined whether the printing data is finished (step S34), and when the judgment result is NO, processing returns to step S30 and the printing operation is continued.

The processing from this step S30 to step S34 is repeatedly performed until the printing data for one sheet of printing medium is finished. In step S32, when the preliminary ejection count $D_t$ for each ink exceeds the preliminary ejection count threshold value $D_L$, the suction pump 31 of the ink receiving unit 30 sucks the ink (step S35). The suction condition when doing this is the suction speed $S_P$ that was set in step S28. After the suction means, the preliminary ejection count is reset (step S36). In other words, the preliminary ejection count $D_t$ is set to 0, and the preliminary ejection count threshold value $D_L$ is set to $1.0\times10^7$ dots (step S37).

After printing data for one sheet of printing data is finished (step S34), how much the current preliminary ejection count $D_t$ is less than the preliminary ejection count threshold value $D_L$, or in other words the amount $(D_L-D_t)$ is calculated, and preliminary ejection is performed for this calculated amount (step S38). Then the suction pump 33 of the ink receiving unit 30 sucks the ink (step S39). After the suction means, the printing head is capped (step S40), and the time count is started (step S41). Finally, the printing medium is ejected (step S42), and the printing process is finished.

In this way, the preliminary ejection count threshold value and the ink suction force of the ink receiving unit 30 are set according to the time count that starts from the suction means of the previous printing operation. In other words, the longer the ink remaining in the ink receiving unit is left, the state of ink adhering advances. Therefore, the amount of ejection for re-dissolving the ink is increased and the suction speed for raising the ink suction force is increased according to the state of adhering ink. That is, the longer time has elapsed, at least one of the ink amount used in preliminary ejection to the ink receiving unit, or the speed of sucking ink to the ink receiving unit is increased.

In the present invention, an increase in the preliminary ejection amount is the increase in the number of preliminary ejections set in step S27 in FIG. 5 and performed instep S38. The cycle of executing the suction means can also be performed multiple times during printing and after printing ends. With this kind of construction and by performing this kind of operation, it is possible to prevent accumulation of adhering ink in the ink receiving unit 30, and ink can be ejected cleanly, so it is possible to keep the ink receiving unit 30, the ink flow path 32 and the like clean. Moreover, in this embodiment, the preliminary ejection count threshold value and ink suction speed are both set according to the time count from the suction means of the previous printing operation. However, the present invention can be such that only one of either the preliminary ejection count threshold value or ink suction speed is set. In this embodiment, just setting the preliminary ejection count threshold value is also effective in both preventing the accumulation of adhering ink in the ink receiving unit and discharging ink cleanly. In this embodiment, the suction means is performed after the printing operation ends, however, the suction means does not need to be performed after the printing operation ends. For example, as in the suction means in step S35, construction can be such that the suction means is performed at a specified timing during the printing operation. In this case, the number of preliminary ejections and the suction speed of the ink can be changed according to the amount of time elapsed from the previous suction means. Furthermore, in this embodiment, for the ink receiving unit, the number of preliminary ejections and the suction speed of the ink are changed according to the amount of time that elapses from the end of the previous printing operation, however, a similar process can be performed for the cap.

(Embodiment 2)

In the first embodiment, the amount of time that elapses from the suction means at the end of the previous printing operation is measured, and as that elapsed time increases, either one or both of an increase in the number of preliminary ejections in order to re-dissolve the ink, and strengthening the suction force in the ink receiving unit was performed. However, the present invention can also control the preliminary ejection count threshold value and the ink suction force in the ink receiving unit by taking into consideration the effect on state of ink adhering in the ink receiving unit due to a cause other than the amount of time that elapses from the suction means at the end of the previous printing operation.

In this embodiment, the effect on the advancement of the state of adhering ink due to the "operating environment of the print apparatus" is taken into consideration in addition to the time count from the suction means at the end of the previous printing operation as explained in the first embodiment using FIG. 5, and even more precise control is performed.

The time count of this embodiment that takes into consideration the adhered state is calculated using the equation below.

(Time count taking into account the adhered ink state)= (Time count from the suction means at the end of the previous printing operation)×(Operating environment coefficient of the print apparatus)×(Openness coefficient of the location where preliminary ejection is performed)

Here, the "operating environment of the print apparatus" is particularly the temperature and humidity. The evaporation rate of ink greatly differs according to the temperature and humidity of the surrounding environment.

Figure 6:
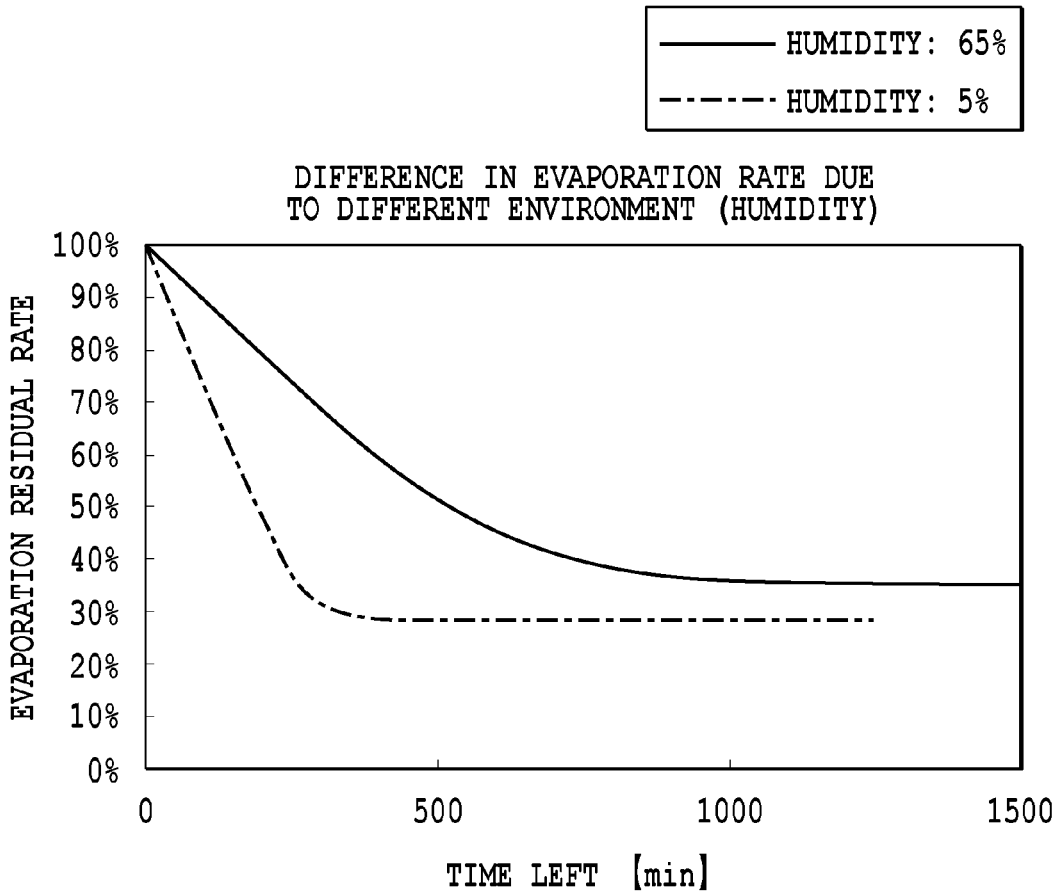
FIG. 6 is a drawing illustrating the relationship between the operating conditions and the evaporation speed of a second embodiment of the invention.

FIG. 6 is a graph illustrating the evaporation residual rate of ink due to differences in the environmental conditions (humidity) for a certain amount of a certain kind of ink. In the figure, it can be seen that the lower the humidity is, the faster the ink evaporates, and the higher the humidity is, the slower the ink evaporates. Moreover, in regards to the temperature, the higher the temperature is, the faster the ink evaporates. Therefore, as evaporation advances, the ink thickens and adheres more easily. Therefore, the higher the humidity is and the lower the temperature is, the easier it is for the ink to thicken and to adhere.

FIG. 7 is a table that illustrates the relationship between the operating environment of the inkjet print apparatus of this embodiment and the weighting coefficients. Based on information from a temperature and humidity sensor, the preliminary ejection count threshold value and the ink suction force in the ink receiving unit are controlled by weighting the time count from the suction means at the end of the previous printing operation by multiplying the time count by the coefficient in FIG. 7 according to the temperature and humidity. As a result, it is possible to both prevent the generation and accumulation of adhering ink inside the ink receiving unit and the ink flow path, and to reduce the number of preliminary ejections for re-dissolving the ink.

Moreover, the "openness of the location where preliminary ejection is performed" is an index that indicates whether the preliminarily ejected ink that remains after the suction means is left in the sealed state, or is unsealed and open. When the location where preliminary ejection is performed is the cap of the recovery system, the ink that remains after the suction means has a sealing effect by being in contact with the head, so the effect of evaporation is considered to be small. However, when preliminary ejection is performed in the ink receiving unit, the ink that remains after the suction means is open, so easily receives the effect of evaporation due to the elapsed time and the operating environment. Therefore, in this embodiment, the preliminary ejection count threshold value and the ink suction force in the location where preliminary ejection is performed is controlled by weighting the time count from the suction means at the end of the previous printing operation according to whether the location where preliminary ejection is performed is sealed or open. More specifically, when the location where preliminary ejection is performed is sealed with the cap in the closed state, the openness coefficient is set to 0.5, and when the location where preliminary ejection is performed with the cap being open or with the ink receiving unit being open, the openness coefficient is set to 1.0. As a result, it is possible to both prevent the generation and accumulation of adhering ink inside the location where preliminary ejection is performed and inside the ink flow path, and to reduce the number of preliminary ejections for re-dissolving the ink.

In this embodiment, the state of adhering ink is detected based on an "operating environment coefficient of the print apparatus" and an "openness coefficient of the location where preliminary ejection is performed", however, of course it is possible to use only one or both coefficients.

(Embodiment 3)

In this embodiment, a recovery control procedure comprising the recovery control procedure of the first embodiment explained using FIG. 5 to which an operation of closing part of the ink flow path is added is explained. In this embodiment, preliminary ejection is performed each scan, and the suction means is performed during the printing operation and after the printing operating is finished.

Figures 8, 8A:
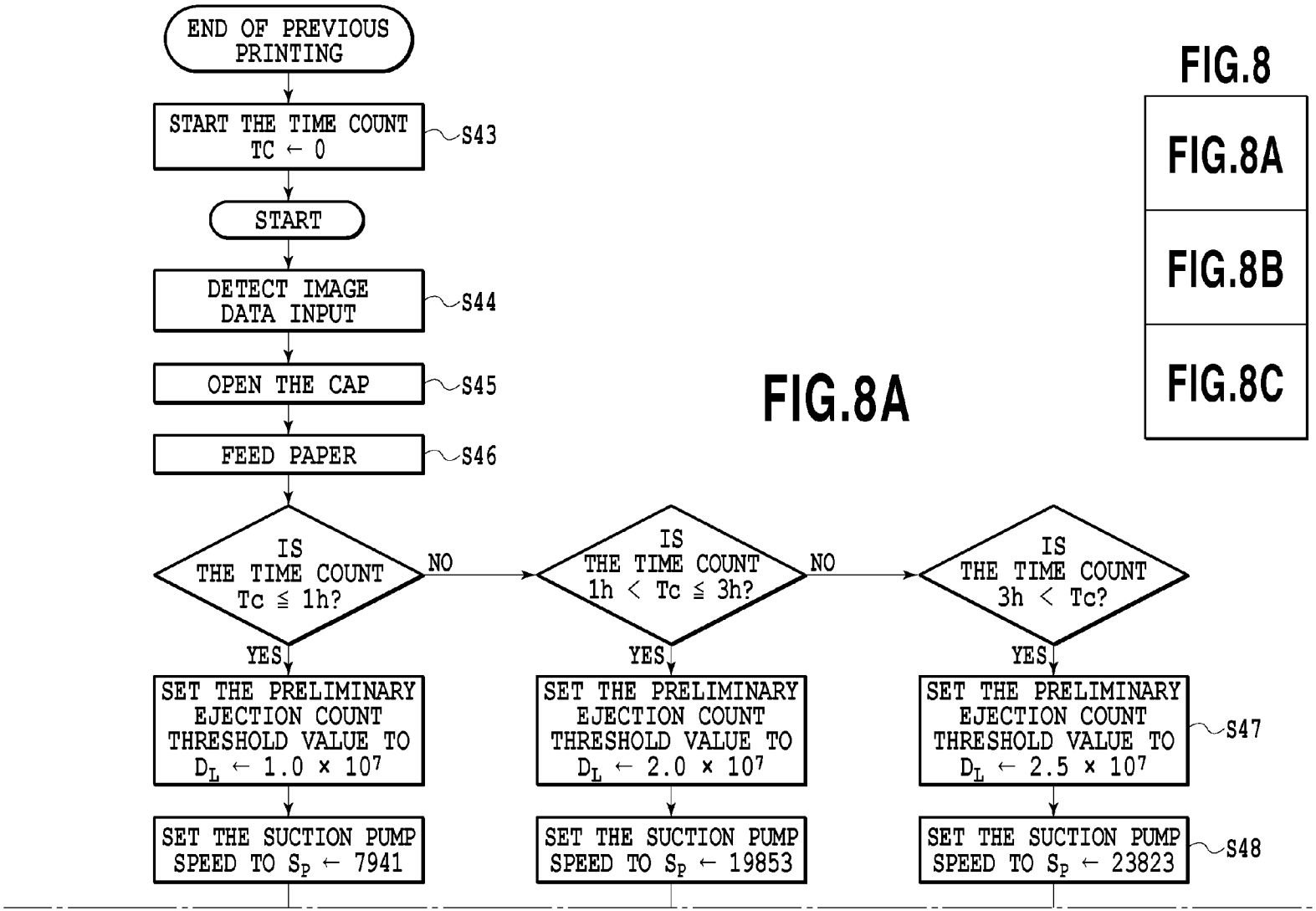
FIG. 8 is a diagram showing the relationship of FIG. 8A to FIG. 8C.
FIG. 8A is a flowchart illustrating the recovery control procedure of a fourth embodiment of the present invention.
Figure 8B:
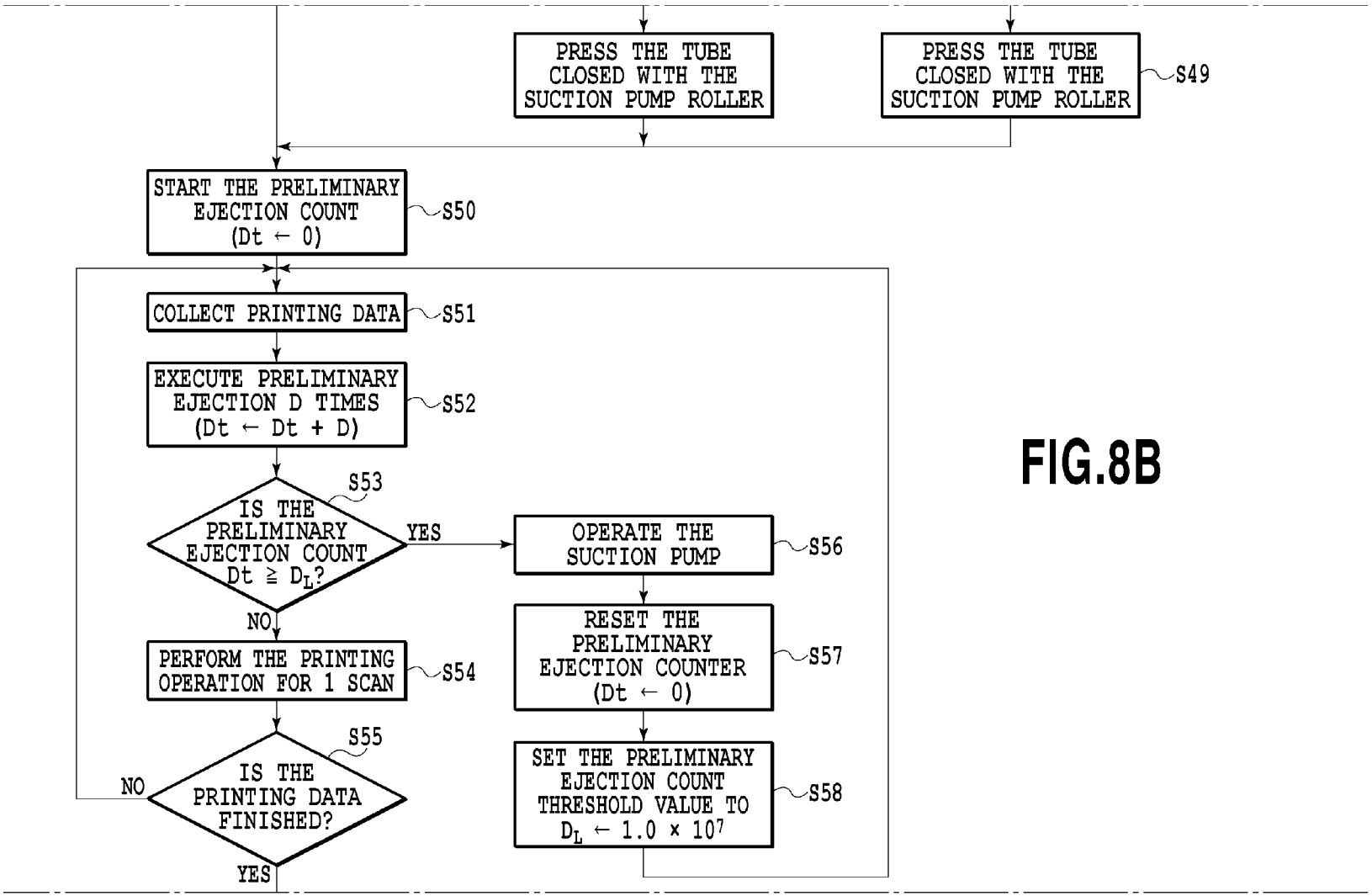
FIG. 8B is a flowchart illustrating the recovery control procedure of a fourth embodiment of the present invention.
Figure 8C:
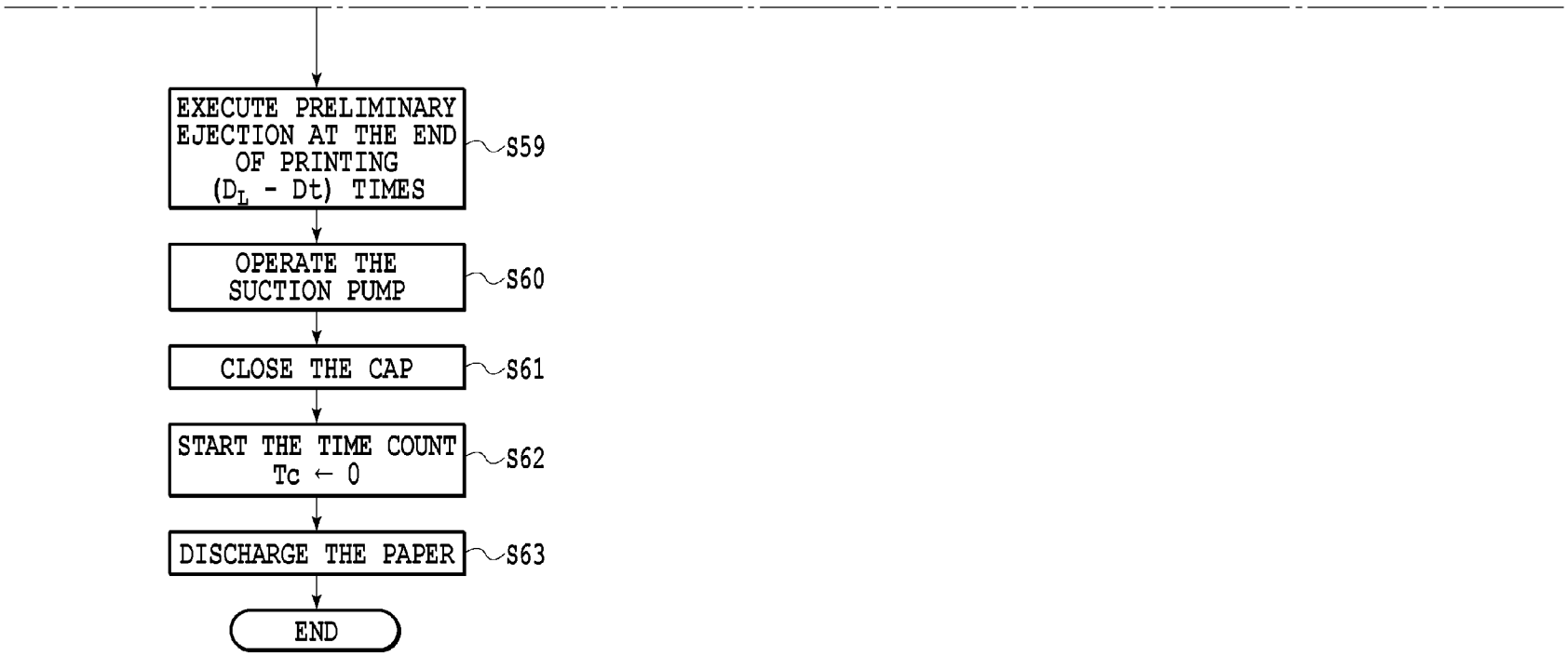
FIG. 8C is a flowchart illustrating the recovery control procedure of a fourth embodiment of the present invention.

FIG. 8 is a flowchart illustrating the control procedure of the printing operation of this embodiment. Here, only the points that differ from the printing operation of the first embodiment explained using FIG. 5 are explained.

In this embodiment, the time count from the suction means at the end of the previous printing operation is read, and when this time count exceeds 1 hour, selection of the preliminary ejection count threshold value $D_L$ (step S47) and selection of the suction pump speed $S_P$ (step S48) are performed. Then, after that, an operation (step S49) to close the ink flow path where the suction means causes ink to flow from the ink receiving unit to waste ink tank is added. More specifically, by rotating the pressure roller of the suction unit and pressing closed the flexible tube of the ink flow path, ink from the ink receiving unit flowing inside the ink flow path stops and it is possible to accumulate ink inside the ink receiving unit. By performing this operation, it is possible to cause ink to accumulate in the ink receiving unit, so it is possible to effectively re-dissolve adhering ink. Furthermore, by collectively sucking the ink after accumulating ink up to the preliminary ejection count threshold value, generation and accumulation of adhering ink in the ink receiving unit and ink flow path is prevented. Therefore, in this embodiment, it is possible to more effectively keep the recovery system clean.

In this embodiment, the operation of rotating the pressure roller of the suction unit and pressing closed the flexible tube of the ink flow path is executed when the time count $T_c$ exceeds 1 hour, however in the present invention, this can be performed even when the time count $T_c$ is equal to or less than 1 hour.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-014314, filed Jan. 26, 2011, which is hereby incorporated by reference herein in its entirety.

What is claimed is:

1. An inkjet print apparatus, comprising:

a printing head configured to eject ink;

an ink receiving unit configured to receive ink ejected from the printing head;

a counting unit configured to count an amount of the ink that is ejected to the ink receiving unit;

a sucking unit configured to execute a sucking operation to suck the ink that is received in the ink receiving unit;

a measuring unit configured to measure an elapsed time from a previous sucking operation; and a control unit configured (i) to cause the sucking unit to execute the sucking operation when the ink amount counted by the counting unit exceeds a first value, in a case where the elapsed time measured by the measuring unit is equal to or shorter than a predetermined time, and (ii) to cause the sucking unit to execute the sucking operation when the ink amount counted by the counting unit exceeds a second value greater than the first value, in a case where the elapsed time is longer than the predetermined time.

2. The inkjet print apparatus according to claim 1, wherein the control unit causes the sucking unit to execute the sucking operation after a printing operation is finished regardless of the ink amount counted by the counting unit.

3. The inkjet printing apparatus according to claim 2, wherein the control unit makes the printing head eject an amount of ink corresponding to a difference between the first value or the second value and the ink amount counted by the counting unit prior to the sucking operation.

4. The inkjet print apparatus according to claim 1, wherein the elapsed time is weighted according to an environment where the inkjet print apparatus is used.

5. The inkjet print apparatus according to claim 1, wherein the elapsed time is weighted according to whether the ink receiving unit is open or sealed.

6. The inkjet print apparatus according to claim 1, wherein suction into the ink receiving unit closes part of an ink flow path where ink flows from the ink receiving unit to a waste ink tank.

7. The inkjet printing apparatus according to claim 1, wherein the control unit (i) causes the sucking unit to drive at a first speed, in a case where the elapsed time measured by the measuring unit is equal to or shorter than the predetermined time and (ii) causes the sucking unit to drive at a second speed faster than the first speed, in a case where the elapsed time is longer than the predetermined time.

8. A control method for an inkjet print apparatus, the control method comprising:

an ejecting step of ejecting ink from a printing head;

a receiving step of receiving ink ejected from the printing head in an ink receiving unit;

a counting step of counting an amount of the ink that is ejected to the ink receiving unit with a counting unit;

a sucking step of executing a sucking operation with a sucking unit to suck the ink that is received in the ink receiving unit;

a measuring step of measuring an elapsed time from a previous sucking operation; and a controlling step of (i) causing the sucking unit to execute the sucking operation when the ink amount counted by the counting unit exceeds a first value, in a case where the elapsed time measured by a measuring unit is equal to or shorter than a predetermined time, and (ii) causing the sucking unit to execute the sucking operation when the ink amount counted by the counting unit exceeds a second value greater than the first value, in a case where the elapsed time is longer than the predetermined time.

9. An inkjet print apparatus comprising:

a printing head configured to eject ink;

an ink receiving unit configured to receive ink ejected from the printing head;

a counting unit configured to count an amount of the ink that is ejected to the ink receiving unit;

a sucking unit configured to execute a sucking operation to suck the ink that is received in the ink receiving unit;

a measuring unit configured to measure an elapsed time from a previous sucking operation; and a control unit configured to cause the sucking unit to execute the sucking operation after causing the print head to eject ink to the ink receiving unit when a sucking instruction is received, in a case where the elapsed time measured by the measuring unit exceeds a predetermined time and the amount of the ink counted by the counting unit is less than a predetermined amount.

10. The inkjet print apparatus according to claim 9, wherein the sucking instruction is issued in a case where a printing operation is finished.

11. The inkjet print apparatus according to claim 9, wherein the control unit causes the sucking unit to execute the sucking operation without causing the print head to eject ink to the ink receiving unit when the sucking instruction is received, in a case where the elapsed time measured by the measuring unit is less than the predetermined time.

12. The inkjet print apparatus according to claim 9, wherein the control unit causes the sucking unit to execute the sucking operation without causing the print head to eject ink to the ink receiving unit when the sucking instruction is received, in a case where the amount of the ink counted by the counting unit exceeds the predetermined amount.

13. The inkjet print apparatus according to claim 9, wherein the control unit causes the sucking unit to execute the sucking operation after a printing operation is finished.

14. The inkjet print apparatus according to claim 9, wherein the elapsed time is weighted according to an environment where the inkjet print apparatus is used.

15. The inkjet print apparatus according to claim 9, wherein the elapsed time is weighted according to whether the ink receiving unit is open or sealed.

* * * * *